United States Patent [19]

Martin

[11] 4,067,496

[45] Jan. 10, 1978

[54] FUEL INJECTION SYSTEM

[75] Inventor: Barrie James Martin, Shenfield, England

[73] Assignee: Plessey Handel und Investments AG, Zug, Switzerland

[21] Appl. No.: 715,006

[22] Filed: Aug. 17, 1976

[30] Foreign Application Priority Data

Aug. 20, 1975 United Kingdom ..... 34531/75

[51] Int. Cl.[2] ..... F02M 27/08; F02M 45/10

[52] U.S. Cl. ..... 239/102; 239/585

[58] Field of Search ..... 239/4, 102, 583–585; 123/119 E, 188 S; 137/533.11; 251/65

[56] References Cited

U.S. PATENT DOCUMENTS 3,620,228 11/1971 Schmid ..... 137/533.11 X 3,949,938 4/1976 Goodinge ..... 239/102

FOREIGN PATENT DOCUMENTS 1,191,240 4/1965 Germany ..... 137/533.11

*Primary Examiner*—Evon C. Blunk

*Assistant Examiner*—Andres Kashnikow

*Attorney, Agent, or Firm*—Fleit & Jacobson

[57] ABSTRACT

A fuel injection system comprising a fuel injection nozzle having a fuel injection orifice, and a vibrator for producing atomization of the fuel injected by the nozzle, the nozzle being equipped at the inlet side of the orifice with a fuel retaining valve which is arranged to normally close the orifice and thus prevent the injection of fuel by the nozzle and which is adapted to move away from the orifice when the vibrator is activated and thus allow the injection of fuel by the nozzle, the nozzle being provided with a mechanical stop device so positioned at a distance from the orifice and in the path of the valve as to limit the maximum possible travel of the valve away from the orifice to that giving a maximum predetermined amount of fuel injection by the system.

12 Claims, 3 Drawing Figures

FUEL INJECTION SYSTEM

This invention relates to a fuel injection system which may be used, for example, in two or four stroke engines, in diesel engines and in domestic and industrial boilers.

Fuel injection systems are known in which the fuel is injected from a fuel injection orifice in a fuel injection nozzle. In these known systems, the fuel injection nozzle is often provided with a vibrator which vibrates the nozzle to produce atomization of the fuel injected by the nozzle.

Various types of vibrator are known. Thus, for example, the vibrator may be a piezoelectric device, a magnetostrictive device, or an electro-magnetic device.

When the fuel injection systems are to be mass produced, difficulties may arise in getting similar fuel injection systems to inject the same amount of fuel. More specifically, in the mass production of the vibrators, slight differences may arise. Thus, for example, in the case of a piezoelectric device, the impedance of the piezoelectric material, or the overall impedance of the fuel injection nozzle, may vary slightly and thus the electrical drive from the piezoelectric device which controls the vibration of the nozzle and therefore the amount of fuel injected, may vary from one fuel system to the next.

It is an aim of the present invention to provide a fuel injection system which can be moe accurately mass produced than many known fuel injection systems.

Accordingly, this invention provides a fuel injection system comprising a fuel injection nozzle having a fuel injection orifice, and a vibrator for producing atomization of the fuel injected by the nozzle, the nozzle being equipped at the inlet side of the orifice with a fuel retaining valve which is arranged to normally close the orifice and thus prevent the injection of fuel by the nozzle and which is adapted to move away from the orifice when the vibrator is activated and thus allow the injection of fuel by the nozzle, the nozzle being provided with a mechanical stop device so positioned at a distance from the orifice and in the path of the valve as to limit the maximum possible travel of the valve away from the orifice to that giving maximum predetermined amount of fuel injection by the system.

The precise position at which it is necessary to fix the mechanical stop device can be determined by experiment. As indicated above, the maximum valve opening is calculated to meet the maximum fuel flow from the injector at the system design pressure. This then sets the position of the mechanical stop. Other orifice effective areas through the valve may be designed such that they are all larger than that through the valve orifice. The electrical drive can be designed such that the minimum output voltage and maximum impedance of the electrical system has sufficient drive to open the valve to this maximum limit. Any additional drive obtained from similar mass produced electrical systems will not then result in greater fuel flows from the injector.

The stop may be positioned such that the maximum distance of travel of the valve is not more than one third the diameter of the valve seat. Preferably, the valve travels from 0.125 to 0.5 mm, especially when the electrical energy to the vibrator is interrupted during periods in an engine cycle when fuel injection is not required. The valve is preferably a ball valve but other constructions of valve may be employed such for example as a cylindrical plug having a conical end for seating on a valve seat. The ball valve preferably has a diameter of from 1 to 3 mm, and the nozzle orifice may have a diameter of from 0.5 to 1.5 mm with the preferred diameter being 1 mm in size. Where the valve is a ball valve seating on a 45° angled slope and the ball valve has a 2 mm diameter, the maximum allowable lift will usually be 0.5 mm as indicated above. Such dimensions are effective to give a continuous fuel flow rate of 650 cubic centimeters per minute. Reducing the distance of travel of the valve substantially proportionally reduces the flow rate. When the electrical energy to the vibrator is interrupted during periods in an engine cycle when fuel injection is not required, it is preferred to limit the amount of valve travel to not more than about 0.75 mm.

Usually, the valve will be freely movable in the housing, in which case it will be held on its valve seat solely by the fuel pressure in the fuel injection nozzle.

The mechanical stop device may comprise restriction means arranged in a fuel passageway in the nozzle leading to the nozzle orifice. The restriction means may be a discrete device positioned in the fuel passageway. Alternatively, the restriction means may be formed by inwardly deforming the fuel passageway.

In one embodiment of the invention, the mechanical stop device may be constituted by the rear wall of a housing in which the valve vibrates.

Preferably, the vibrator employed in the present invention is a piezoelectric device.

The fuel injection system of the present invention may be such that the fuel injection nozzle is provided with swirl means for causing the fuel to swirl within the fuel injection nozzle prior to its being injected by the nozzle to an engine or boiler, for example. Various types of fuel swirling device may be employed such for example as helical passages in the fuel path leading to the injection orifice or radially disposed, tangentially directed slots in the above mentioned housing. Where swirl slots are employed, the diameter of the slots is preferably slightly greater than the diameter of the nozzle orifice.

The fuel injection system of the present invention may include a fuel feed device for providing a flow of fuel to the nozzle. The system may also include a timing control device which limits the nozzle vibrations, e.g. ultrasonic vibrations, to uniformly spaced periods. Each timing period may constitute an adjustable part of a cycle related to the revolution of an engine. The fuel injection system may be used to inject fuel directly into an engine or boiler, or alternatively into an air intake conduit leading to the engine or boiler.

When the fuel injection nozzle is vibrated, it will usually be vibrated with so-called "ultrasonic vibrations" or at so-called "ultrasonic frequency". These vibrations will obviously be sufficient to cause the fuel to disintegrate into small mist-like particles. The frequency range in question may in practice be found to have its lower limit somewhere near the upper limit of audibility to a human ear. However, for reasons of noise suppression, it is generally preferable in practice to use frequencies high enough to ensure that audible sound is not produced.

Embodiments of the invention will now be described solely by way of example and with reference to the accompanying drawings, in which.

Figure 1:
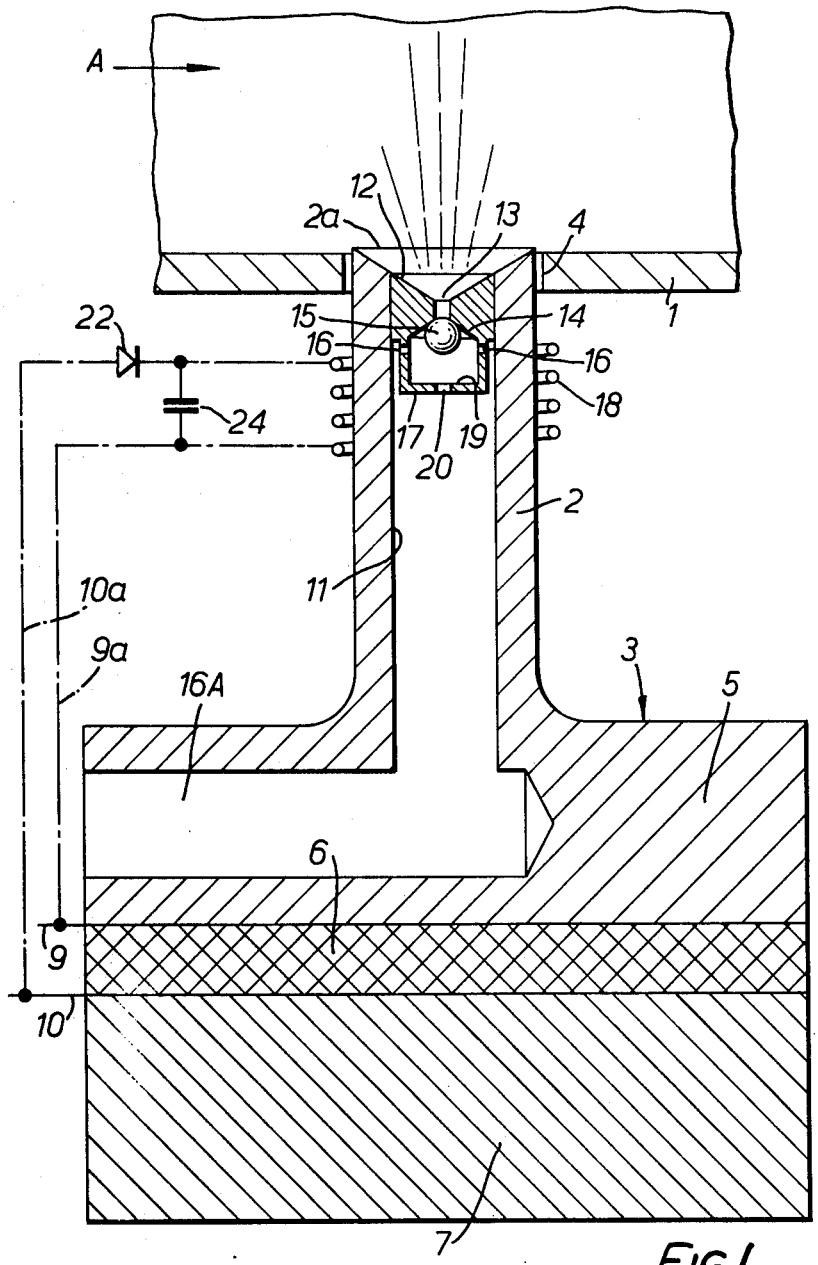
FIG. 1 shows a first fuel injection system in accordance with the invention.

Referring to FIG. 1, there is shown a passage 1 which may be the induction line of an internal combustion engine or, for example, a passage leading from the air compressor to the burners of a turbojet engine or other gas turbine engine. In order to inject liquid fuel into the combustion air which may be assumed to pass through the line in the direction of arrow A, a cylindrical nozzle portion 2 of a fuel injection nozzle 3 is arranged to project with its end 2*a* through an aperture 4 in the wall of the passageway 1. The fuel injection nozzle 3 projects in such a manner as to provide substantially sealing operation, while permitting movement in the longitudinal direction of the portion 2.

The cylindrical portion 2 forms a so-called horn at one side of the large diameter portion 5. Attached at the opposite side of the portion 5 is a vibrator in the form of a piezoelectric transducer element 6. An optional balancing body 7 is attached to the opposite side of the transducer element 6.

The fuel injection system is such that when an alternating voltage of an ultrasonic frequency is applied to the piezoelectric element 6 by means of wires 9 and 10, resonant ultrasonic vibrations in the longitudinal direction of the cylindrical horn portion 2 are applied to the large diameter portion 5. The portion 5 amplifies the vibrations and the nozzle 3 is so dimensioned that the maximum amplitude of the oscillations is generated near the end portion 2*a* of the horn portion 2.

Arranged coaxially in the cylindrical horn portion 2 is a fuel passage 11. In order to provide a spray nozzle, the passage 11 is formed near the end 2*a* of the horn portion 2 with an inwardly projecting shoulder portion 12 which defines a nozzle orifice 13. The portion 12 is formed with a conical valve seat 14 which co-operates with a ball valve 15. The ball valve 15 is freely movable in a housing 17.

Liquid fuel under suitable pressure is admitted to the passage 11 by a transverse bore 16A formed in the portion 5 of the nozzle 3.

The housing 17 surrounds the ball valve 15 and fuel from the passage 11 is allowed to enter the inside of this housing, mainly by means of radial slots or passages 16 which are arranged around the housing 17. The slots or passages 16 communicate with the inside of the housing 17 and are preferably tangentially arranged so that the fuel introduced into the inside of the housing 17 is caused to swirl. This fuel swirlage can assist in the atomization of the fuel.

The fuel injection system as so far described operates as follows. Usually, the fuel in the passage 11 and inside the housing 17 will cause the ball valve 15 to be held against the valve seat 14. This will normally prevent any fuel from leaving the fuel injection nozzle 3 through the orifice 13 and thus being directed into the flow of combustion air in the duct 1. When, however, an alternating voltage of the appropriate ultrasonic frequency is applied to the piezoelectric transducer element 6 by the wires 9 and 10, the resultant resonant vibration of the end portion 2*a* will produce dynamic forces upon the valve 15. The valve 15 will be lifted off its seat 14 thus permitting fuel from within the housing 17 to pass through the nozzle orifice 13 into the duct 1. There will thus be produced in the duct 1, while the ultrasonic vibrations take place, a spray of atomized fuel which becomes intimately mixed with the flow of combustion air in the duct 1. This will produce a desired fuel and air mixture so long as the ultrasonic frequency is applied to the piezoelectric transducer element 6.

Now it is obviously desired that there should be a precise degree of control over the amount of fuel injected into the duct 1, thereby to avoid fuel wastage. It may thus sometimes happen that due to variations in the piezoelectric transducer element 6, or to variations in the voltage in wires 9, 10, too much electrical drive will be used to vibrate the atomizer and in this case the ball valve 15 may be vibrated too far off its seat 14. If the ball valve 15 is vibrated too far off its seat 14, then obviously too large packages of fuel will be admitted through the orifice 13 and fuel wastage will occur.

In order to avoid this fuel wastage, the end wall 19 of the housing 17 is so arranged to be at a distance from the nozzle orifice 13 and in the path of the valve 15 as to limit the maximum possible travel of the valve 15 away from the nozzle orifice 13 to that giving the maximum desired amount of fuel injection by this system. It will thus be apparent that if the ball valve can only travel a certain maximum distance from the orifice 13, then this will govern the maximum amount of fuel allowed to pass through the orifice 13.

The precise distance of the wall 19 from the orifice 13 can be determined by experiment and will obviously vary depending upon the precise type of engine or boiler in which the fuel injection is to be installed. Generally, the wall 19 will be so positioned as to limit the travel of the valve 15 to a maximum distance of from 0.125 to 0.5 mm.

The wall 19 is provided with an orifice 20 and it sometimes may occur that the valve 15 will take up a position adjacent the face 19 of the housing 17. The valve 15 may stay in this position even when the nozzle is not being vibrated, in the absence of the aperture 20. With the aperture 20, fuel passing along the passage 16A, enters the aperture 20 and can act on the valve 15 to force it towards its seat 14.

The embodiment of the invention illustrated in FIG. 1 also shows means for increasing the rate of flow permitted by the ball valve 15 above the rate achieved when inertia action due to the vibrations is exclusively relied on. The additional means comprises a solenoid winding 18 arranged around the horn portion 2 at a suitable axial position. The cylindrical horn portion 2 is made of non-magnetic material, while the valve 15 consists of magnetised steel or other suitable magnetic material. The winding 18 is so positioned that the valve 15 is lifted off its seat 14 by magnetic action when the winding 18 is energised. The energising current is preferably direct current since otherwise the cylindrical portion 2 should be made of a material having sufficiently low electrical conductivity to avoid undue screening action by induced current.

Suitable means may be provided for the appropriate timing of the energising current pulses for the winding 18. In the illustrated embodiment, these pulses have been arranged to coincide with the pulses of ultrasonic frequency current supplied to the piezoelectric element 6 by connecting the winding, by a rectifier arrangement 22, 24, across the wires 9, 10, as shown by chain-connected lines in 9*a*, 10*a*.

Figure 2:
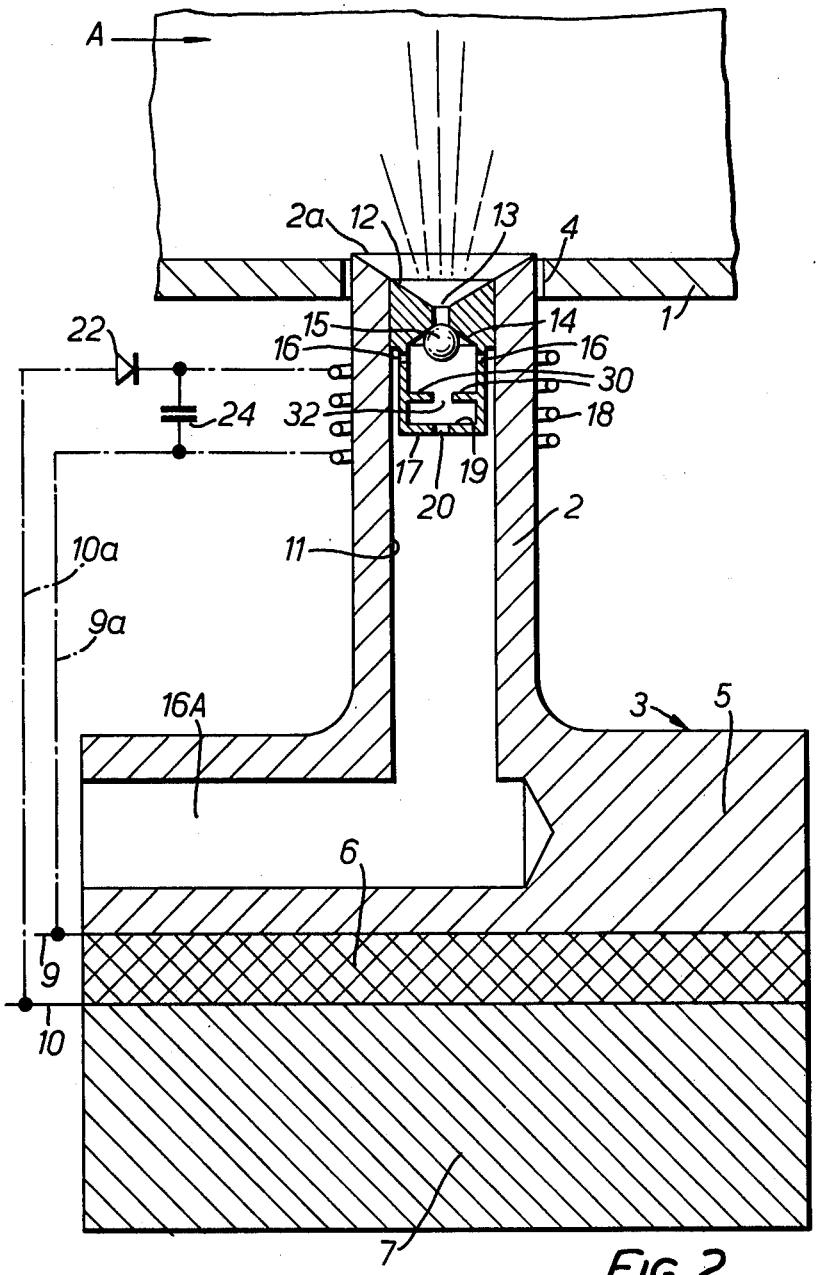
FIG. 2 shows a second fuel injection system in accordance with the invention.

Referring now to FIG. 2, there is shown a fuel injection system which is very similar to that shown in FIG. 1 and in which similar parts have been given the same reference numeral. To avoid undue repetition of the description, the precise construction of operation of the parts similar to those shown in FIG. 1 will not again be described.

In FIG. 2, the end wall 19 of the housing 17 is further away from the orifice 13 than in FIG. 1 and is too far to constitute the mechanical means for stopping the travel of the ball valve 15 at its maximum desired position. In the case of FIG. 2, the housing 19 is provided with an inwardly projecting shoulder 30 having a central aperture 32. The shoulder 30 limits the longitudinal travel of the valve 15 to the maximum desired valve and the fuel passing through orifice 20 can also pass through orifice 32 and act on the valve 15 should it become positioned against the shoulder 30.

In an alternative embodiment not illustrated, the shoulder 30 can be replaced with inwardly projecting rods or spikes, e.g. three, which will define the opening 32 and which will act as the mechanical means for stopping the travel of the valve 15 at its maximum desired position.

Figure 3:
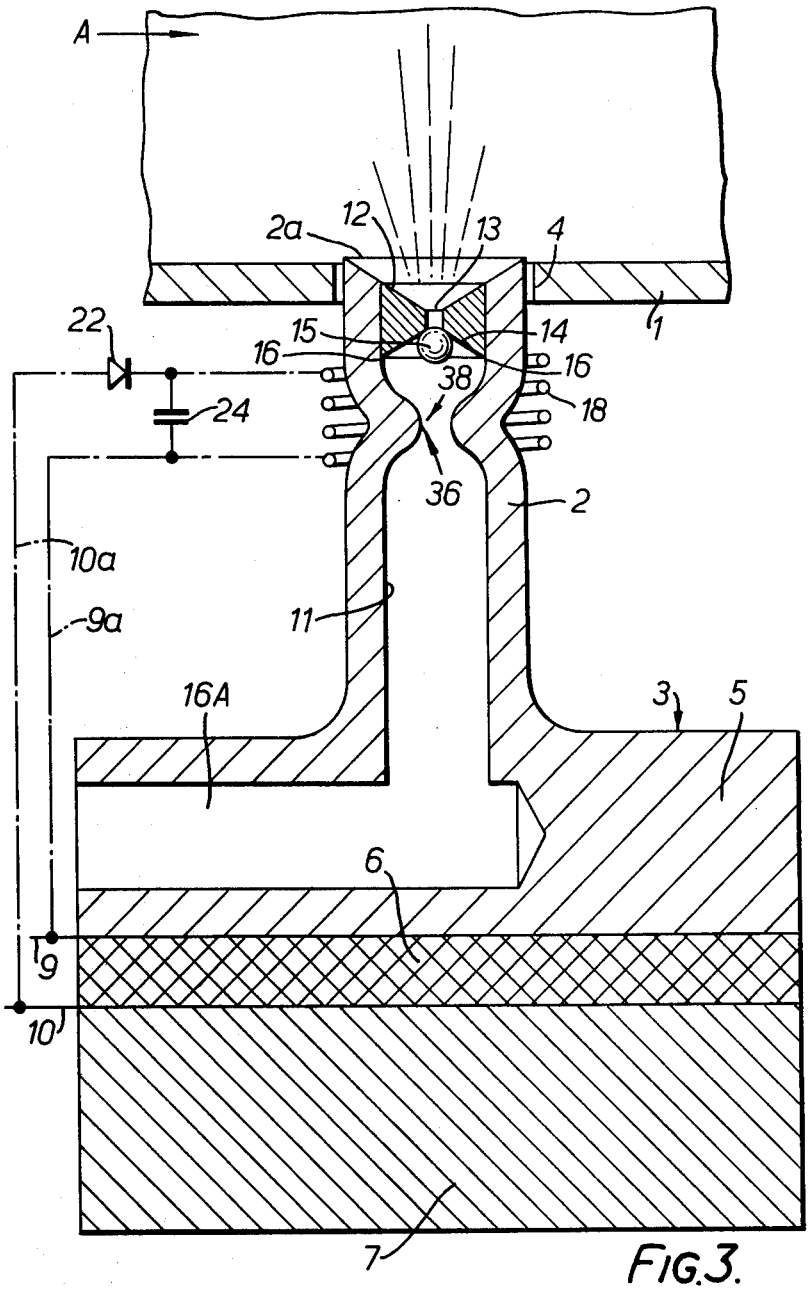
FIG. 3 shows a third fuel injection system in accordance with the invention.

Referring now to FIG. 3, there is shown another arrangement similar to that shown in FIG. 1 and similar parts have been given the same reference numeral. The precise construction and operation of these parts will not be given again in detail to avoid undue repetition.

In FIG. 3, the housing 17 has been removed and the mechanical stop means is constituted by an internal shoulder 36 formed by inwardly deforming the nozzle 2. The shoulder 36 defines an aperture 38 which allows the passage of fuel from the passage 16A to the orifice 13 when the nozzle is being vibrated as aforesaid.

It is to be appreciated that the embodiments of the invention described above have been given by way of example only and that modifications may be effected. Thus, for example, other means of swirling the fuel than the apertures 16 shown in FIG. 1 may be employed. Also, the fuel swirlage means could take the form of helical grooves formed in the inside wall of the housing 17, or in the passage 11 when the housing 17 is not present. The fuel swirlage means could also be a coil spring which could replace the helical grooves.

What we claim is:

1. A fuel injection system comprising a fuel injection nozzle having a fuel injection orifice, and a vibrator for producing atomization of the fuel injected by the nozzle, the nozzle being equipped at the inlet side of the orifice with a fuel retaining valve means comprising a ball valve and a ball valve seat, the ball valve normally closing the orifice and thus preventing the injection of fuel by the nozzle and which is adapted to move away from the orifice when the vibrator is actuated and thus allow the injection of fuel by the nozzle, the nozzle being provided with means for limiting the maximum possible travel of the ball valve comprising a mechanical stop device so positioned at a distance from the orifice and in the path of the ball valve as to limit the maximum possible travel of the ball valve away from the orifice to not more than 0.75 millimeters for injecting a maximum predetermined amount of fuel by the system, and wherein the ball valve has a diameter of from 1 to 3 millimeters.

2. A fuel injection system according to claim 1, in which the ball valve has a diameter of 2 millimeters.

3. A fuel injection system according to claim 1, in which the nozzle orifice has a diameter of from 0.5 to 1.5 millimeters.

4. A fuel injection nozzle according to claim 3, in which the nozzle orifice has a diameter of 1 millimeter.

5. A fuel injection system according to claim 1, in which the mechanical stop device comprises restriction means arranged in a fuel passageway in the nozzle leading to the nozzle orifice.

6. A fuel injection system according to claim 5, in which the restriction means is a discrete device positioned in the fuel passageway.

7. A fuel injection system according to claim 6, in which the restriction means is a rear wall forming part of a housing in which the valve moves.

8. A fuel injection system according to claim 7, in which the rear wall of the housing is provided with an aperture for allowing fuel to enter the housing at a position adajcent the position to which the valve moves when the vibrator is activated.

9. A fuel injection system according to claim 8, in which swirl slots are formed in side walls forming part of the housing, the swirl slots enabling fuel to enter the housing with a swirling action.

10. A fuel injection system according to claim 9, in which the vibrator is a piezoelectric device.

11. A fuel injection system according to claim 10, and including a fuel feed device for providing a flow of fuel to the nozzle.

12. A fuel injection system according to claim 10, and including a timing control device which limits the energisation of the vibrator to uniformly spaced periods.

* * * * *